US011849789B2

(12) United States Patent
Imai

(10) Patent No.: US 11,849,789 B2
(45) Date of Patent: Dec. 26, 2023

(54) ARTIFICIAL HAIR FASTENING TOOL AND ARTIFICIAL HAIR FASTENING METHOD TECHNICAL FIELD

(71) Applicant: HARUCHI, G.K., Suita (JP)

(72) Inventor: Chiharu Imai, Suita (JP)

(73) Assignee: HARUCHI, G.K., Suita (JP)

( * ) Notice: Subject to any disclaimer, the term of this patent is extended or adjusted under 35 U.S.C. 154(b) by 187 days.

(21) Appl. No.: 17/553,825

(22) Filed: Dec. 17, 2021

(65) Prior Publication Data

US 2022/0104572 A1 Apr. 7, 2022

Related U.S. Application Data

(63) Continuation of application No. PCT/JP2020/028620, filed on Jul. 27, 2020.

(30) Foreign Application Priority Data

Sep. 10, 2019 (JP) ..... 2019-164991

(51) Int. Cl.
*A41G 5/00* (2006.01)

(52) U.S. Cl.
CPC ..... *A41G 5/0086* (2013.01); *A41G 5/006* (2013.01); *A41G 5/0046* (2013.01)

(58) Field of Classification Search
CPC ..... A41G 5/002; A41G 5/0053; A41G 5/006; A41G 5/0086; A41G 5/0046
See application file for complete search history.

(56) References Cited

U.S. PATENT DOCUMENTS

| | | | | |
|---|---|---|---|---|
| 5,775,341 | A * | 7/1998 | Abe | A41G 5/0046 132/200 |
| 6,910,486 | B2 * | 6/2005 | Makino | A41G 5/0046 132/201 |
| 2016/0220011 | A1 * | 8/2016 | Minato | A45D 44/02 |

FOREIGN PATENT DOCUMENTS

| | | |
|---|---|---|
| JP | 5-156506 | 6/1993 |
| JP | 6-79717 | 11/1994 |
| JP | 9-268414 | 10/1997 |
| JP | 2002-194612 | 7/2002 |
| JP | 2006-63457 | 3/2006 |
| JP | 2006-152486 | 6/2006 |
| JP | 2011-202324 | 10/2011 |
| JP | 2013-209781 | 10/2013 |

* cited by examiner

*Primary Examiner* — Rachel R Steitz
(74) *Attorney, Agent, or Firm* — Winston Hsu

(57) ABSTRACT

An artificial hair fastening tool is provided which enables efficient operations of putting a human hair into a loop of an artificial hair and making a knot in the human hair for preventing the artificial hair from coming off. An artificial hair fastening method for fastening an artificial hair to a human hair efficiently and without imposing strain on the human hair is also provided. The artificial hair fastening tool includes: a front end portion having a spindle shape with a groove on a circumferential surface along a longitudinal direction and having a tip end on one end; and a rear end portion having a rod-like shape and extending from the front end portion toward an opposite side to the tip end.

3 Claims, 6 Drawing Sheets

ARTIFICIAL HAIR FASTENING TOOL AND ARTIFICIAL HAIR FASTENING METHOD TECHNICAL FIELD

CROSS REFERENCE TO RELATED APPLICATIONS

This patent application is a continuation of International Application PCT/JP2020/028620 filed Jul. 27, 2020. The present application is based on and claims priority to International Application PCT/JP2020/028620 filed Jul. 27, 2020, the contents of which are hereby incorporated by reference in their entirety.

BACKGROUND OF THE INVENTION

1. Field of the Invention

The present invention relates to a tool for fastening an artificial hair to a human hair and a method for fastening an artificial hair to a human hair.

2. Description of the Prior Art

Fastening artificial hair to human hair has been known as a method to add volume to hair. An exemplary method would be making a loop at a distal end of an artificial hair, putting a human hair through the loop of the artificial hair, sliding the loop close to the scalp, where the loop is fastened firmly, and thereby securing the artificial hair to a root portion of the human hair.

For example, Patent Document 1 discloses putting a loop of an artificial hair over a tubular member having a through hole inside to tie the artificial hair to the outer circumferential surface of the tubular member, and inserting the human hair in the through hole of the tubular member and then removing the loop of the artificial hair from the tubular member to make the human hair pass through the loop of the artificial hair.

Patent Document 2 and Patent Document 3 each disclose another tool and method for making a human hair pass through a loop of an artificial hair.

Another exemplary method would be tying a knot in a human hair at a position closer to the operator (i.e., closer to the distal end of the human hair) than the position where a loop of an artificial hair is fastened to the human hair to prevent the loop of the artificial hair fastened to the human hair from coming off the human hair.

For example, Patent Document 4 discloses a tool and a method for tying a knot in a human hair much closer to a loop portion of an artificial hair to prevent the artificial hair from coming off.

Further, human hair grows in a certain period from fastening of the artificial hair to the vicinity of the root of the human hair, causing the loop portion of the artificial hair fastened to the human hair to be apart from the scalp, which results in an unnatural appearance or unsmooth texture.

To address this, there is an artificial hair fastening method capable of untying an old knot that is apart from the scalp and moving the loop portion of the artificial hair fastened to the grown human hair to the vicinity of the root of the human hair.

For example, Patent Document 5 discloses a method of fastening an artificial hair, in which a knot of a human hair for preventing an artificial hair from coming off is formed at a position closer to the operator than a position of a loop portion of the artificial hair fastened to the human hair such that the knot can be untied by pulling, and the artificial hair is fastened by putting an end of the artificial hair through this knot. In this method, to untie the knot for preventing the artificial hair from coming off, the end of the artificial hair is pulled out from the knot, and the knot of the human hair is untied by pulling.

CITATION LIST PATENT DOCUMENTS

Patent Document 1: Japanese Unexamined Patent Publication No. H5-156506

Patent Document 2: Japanese Unexamined Patent Publication No. H9-268414

Patent Document 3: Japanese Unexamined Patent Publication No. 2002-194612

Patent Document 4: Japanese Unexamined Patent Publication No. 2013-209781

Patent Document 5: Japanese Unexamined Patent Publication No. 2006-63457

SUMMARY OF THE INVENTION

To enhance the hair volume increase effect by fastening artificial hair to human hair as a method to add volume to hair, artificial hairs need to be fastened to quite a large number of human hairs. Efficient operations are therefore required in fastening the artificial hairs.

However, according to the method disclosed in Patent Document 1, the human hair that has been inserted into the loop of the artificial hair needs to be pulled out from the tubular member in order to make a knot in the human hair for preventing the artificial hair from coming off, which results in a loss of working time. Besides, another tool is necessary to make the knot for preventing the artificial hair from coming off, which makes it difficult to perform a series of operations of fastening the artificial hair to the human hair efficiently.

In Patent Document 2 and Patent Document 3, as well, another tool is necessary to make a knot for preventing the artificial hair from coming off, which makes it difficult to perform a series of operations of fastening the artificial hair to the human hair efficiently.

In Patent Document 4, as well, different tools are necessary to perform an operation of putting a human hair into the loop of the artificial hair and an operation of forming a knot in the human hair for preventing the artificial hair from coming off. Thus, a series of operations cannot be performed consecutively, which makes it difficult to enhance the efficiency of the operations.

Also in the case of untying the knot for preventing the artificial hair from coming off, which is apart from the root of the human hair due to the growth of the human hair, it is desired to untie the artificial hair efficiently and without imposing strain on the root portion of the human hair.

However, in Patent Document 5, the artificial hair inserted in the knot of human hair needs to be pulled out before untying the old knot, which is not efficient work. Besides, the knot is untied by pulling the human hair itself, which imposes strain on the root portion of the human hair.

It is therefore an objective of the present invention to provide a tool that enables efficient operations of putting a human hair into a loop of an artificial hair and making a knot in the human hair for preventing the artificial hair from coming off. A method for fastening an artificial hair to a human hair efficiently and without imposing strain on the human hair is also provided.

SOLUTION TO THE PROBLEM

An artificial hair fastening tool according to the present invention includes:

a front end portion having a spindle shape and having a tip end on one end and a groove on a circumferential surface along a longitudinal direction; and a rear end portion having a rod-like shape and extending from the front end portion toward an opposite side to the tip end.

A method for fastening artificial hair to human hair, the artificial hair including:

a first artificial hair element having a first loop at one end, the first loop being capable of being tightened; and a second artificial hair element having a second loop at one end, the second loop being capable of being tightened, the method including:

passing at least one thread of the human hair through the first and second loops;

tightening the first and second loops to secure the first and second artificial hair elements to the human hair; and forming an overhand knot in the human hair at a position closer to a root of the human hair than the first and second loops.

ADVANTAGES OF THE INVENTION

The artificial hair fastening tool of the present invention enables efficient operations of fastening an artificial hair to a human hair. The artificial hair fastening method of the present invention can add volume to human hair efficiently and without imposing strain on the human hair.

These and other objectives of the present invention will no doubt become obvious to those of ordinary skill in the art after reading the following detailed description of the preferred embodiment that is illustrated in the various figures and drawings.

DETAILED DESCRIPTION

FIGS. 1A to 1D illustrate an artificial hair fastening tool 1 according to the present embodiment.

Figure 1A:
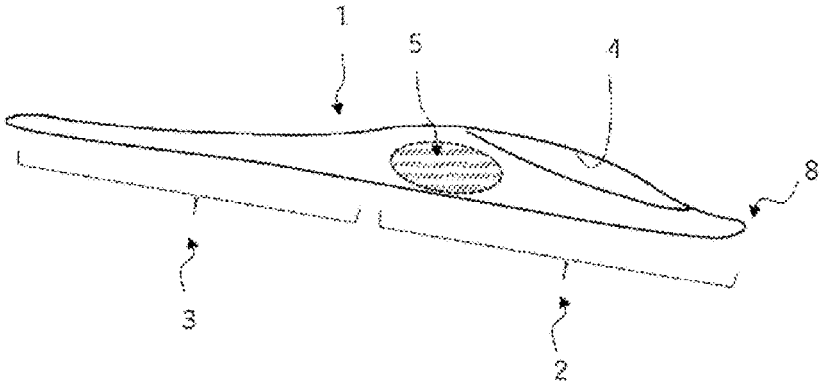
FIGS. 1A to 1D illustrate diagrams for explaining an artificial hair fastening tool according to the present embodiment.

FIG. 1A is a perspective view of the artificial hair fastening tool 1 according to the present embodiment. The artificial hair fastening tool 1 has a front end portion 2 and a rear end portion 3. The front end portion 2 has a spindle shape and has a groove 4 on its circumferential surface along a longitudinal direction. The front end portion 2 has a tip end 8 on one end. The rear end portion 3 has a rod-like shape and extends from the front end portion 2 toward an opposite side to the tip end 8.

A portion indicated by slashes 5 is a portion of the circumferential surface of the front end portion 2, and is a portion where the thumb touches when the artificial hair fastening tool 1 is gripped with a left hand. Desirably, the spindle shape at this portion has a greater thickness and a wider area so that the thumb stabilizes when gripping the tool.

Figure 1B:
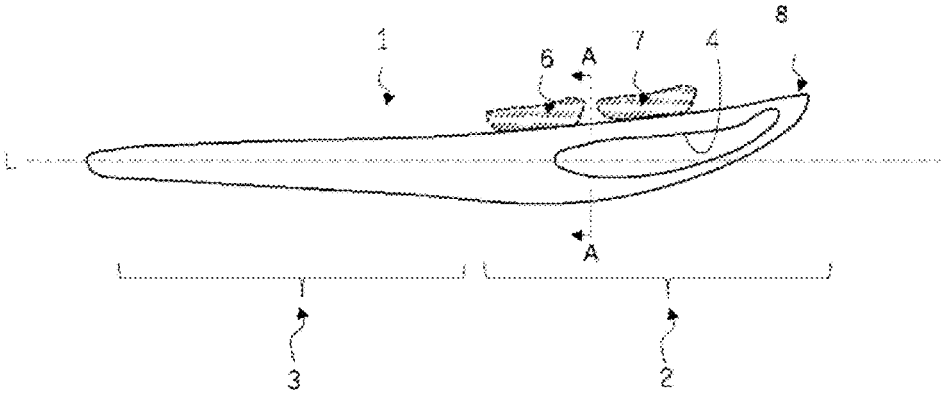

FIG. 1B is a plan view of the artificial hair fastening tool 1 as viewed from the side where the groove 4 is formed. Portions indicated by slashes 6 and 7 correspond to positions where the index finger and the middle finger touch when the artificial hair fastening tool 1 is gripped with a left hand. The front end portion 2 of the artificial hair fastening tool 1 slightly curves to the left toward the front. The "toward the front" is a direction from the rear end portion 3 to the front end portion 2.

Due to this curved shape, the person gripping the artificial hair fastening tool 1 can put their index and middle fingers naturally along the side surface of the artificial hair fastening tool 1, which can stabilize the index and middle fingers when the person grips the artificial hair fastening tool 1.

Further, when the artificial hair fastening tool 1 is gripped with a left hand, the tip end 8 of the front end portion 2 is directed to the skin from which a human hair of the subject person stands up. Thus, the tip end 8 can be vertical to the skin without the need to arrange the artificial hair fastening tool 1 itself vertically to the skin. This makes it possible to apply a force to the root of the human hair easily and facilitates operations, such as making a knot in a root portion of the human hair.

Figure 1C:
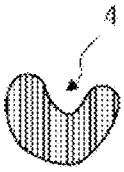

FIG. 1C is a lateral cross section of the front end portion 2 taken along the line A-A shown in FIG. 1B, and includes a cross section of the groove 4. The cross section of the groove 4 may have a concave shape along its length.

The color of the artificial hair fastening tool 1 is not particularly limited, but is better to be a color that provides a great contrast with the color of the human hair of the subject person. A white color is desirable in a case of treating the human hair in dark colors, such as black or brown. On the other hand, dark colors, such as black, are desirable in a case of treating a subject person with grey hair or the like. This is because human hair can be clearly distinguished due to the contrast between the artificial hair fastening tool 1 and the human hair, and thus because it is possible to facilitate the operation.

In a case in which the operator uses the right hand, the artificial hair fastening tool 1 preferably has a shape that is laterally inverted with respect to the long two dot chain line L in FIG. 1B. In such a case, the front end portion 2 of the artificial hair fastening tool 1 slightly curves to the right toward the front. Desirably, the artificial hair fastening tool 1 has a smooth circumferential surface, and the artificial hair fastening tool 1 has a thickness that is gently reduced from the front end portion 2 to the rear end portion 3.

Figure 1D:
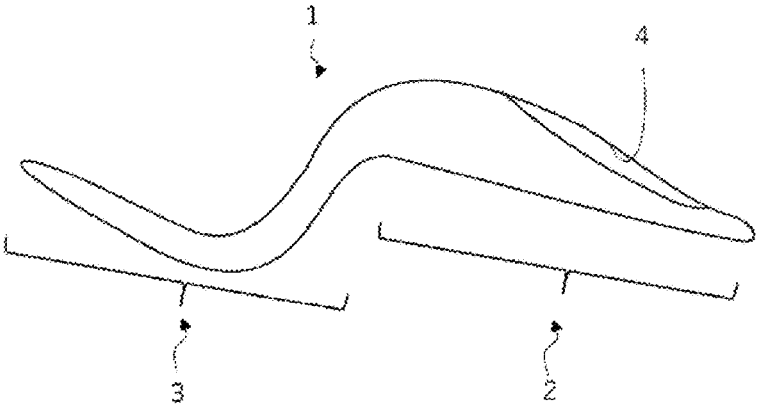

Members constituting the artificial hair fastening tool 1 may be integrally formed of a single material, or may be formed by combining a plurality of members made of the same or different materials. Examples of the material include a synthetic resin (plastic), stainless steel, and any other suitable materials. As illustrated in FIG. 1D, the rear end portion 3 of the artificial hair fastening tool 1 may extend from the front end portion 2 toward the opposite side to the tip end 8 while making a curve.

FIGS. 2A to 2D illustrate an artificial hair element for use in an artificial hair fastening method according to the present embodiment.

Figure 2A:
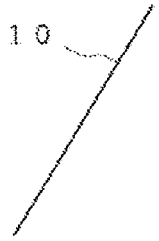
FIGS. 2A to 2D illustrate diagrams for explaining an artificial hair for use in an artificial hair fastening method according to the present embodiment.
Figure 2B:
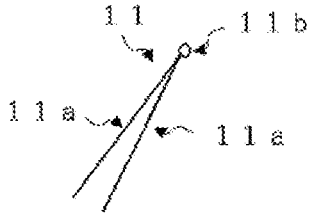

FIG. 2A illustrates a thread of fiber 10 for the artificial hair element. FIG. 2B illustrates a piece of the artificial hair element 11 made of the fiber 10. The artificial hair element 11 is formed by bending the fiber 10. Both ends of the fiber 10 make two threads of artificial hair 11*a*. A loop 11*b* for attachment to human hair is provided at the bent portion of the fiber 10.

Figure 2C:
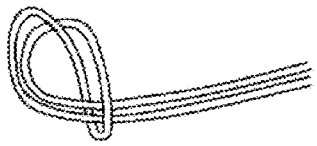
Figure 2D:
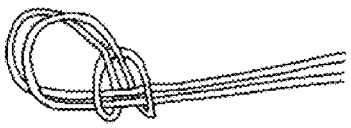

The loop 11*b* is configured to be capable of being tightened to enable firm fastening, such as the loops illustrated in FIGS. 2C and 2D.

Fastening of the loop 11*b* of this artificial hair element 11 to a human hair enables addition of two threads of artificial hair 11*a* to one thread of human hair. It is also possible to fasten a plurality of artificial hair elements 11 to one thread of human hair. In this case, more artificial hair 11*a* can be added to one thread of human hair.

Figure 3A:
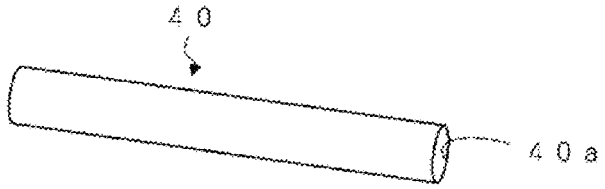
FIGS. 3A to 3C illustrate diagrams for explaining a tool to be used together with the artificial hair fastening tool according to the present embodiment.
Figure 3B:
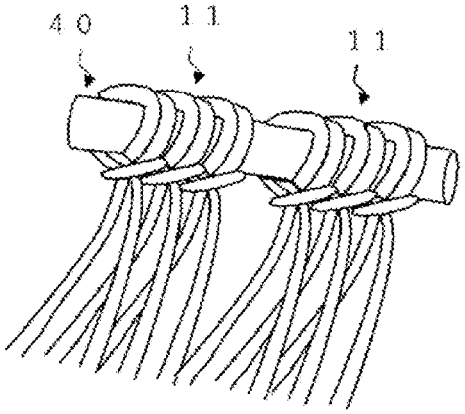
Figure 3C:
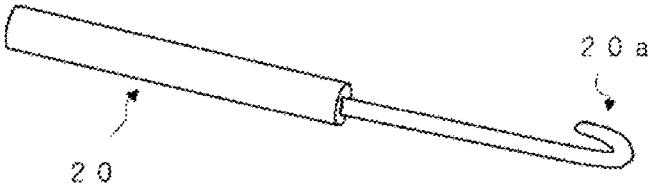

FIGS. 3A to 3C illustrate diagrams for explaining a tool to be used together with the artificial hair fastening tool 1.

FIG. 3A illustrates a tubular member 40 that has a through hole 40*a* inside. The tubular member 40 is a tool for temporarily holding the artificial hair element 11 before being fastened to a human hair. As illustrated in FIG. 3B, the loop 11*b* of the artificial hair element 11 is put over, and tied on, the circumference of the tubular member 40, thereby making it possible to secure the artificial hair element 11 to the tubular member 40.

During fastening of the artificial hair, the rear end portion 3 of the artificial hair fastening tool 1 is inserted in the through hole 40*a* of the tubular member 40 to secure the tubular member 40 to the artificial hair fastening tool 1. It is therefore possible to keep a plurality of artificial hair elements 11 handy for the operator, which can enhance the efficiency of the consecutive operations by the operator on a plurality of human hairs.

FIG. 3C illustrates a hook needle 20 having a hook 20*a* at its distal end. The hook needle 20 is used to fasten an artificial hair to a human hair.

Now, an artificial hair fastening method according to the present embodiment will be described.

Figure 4A:
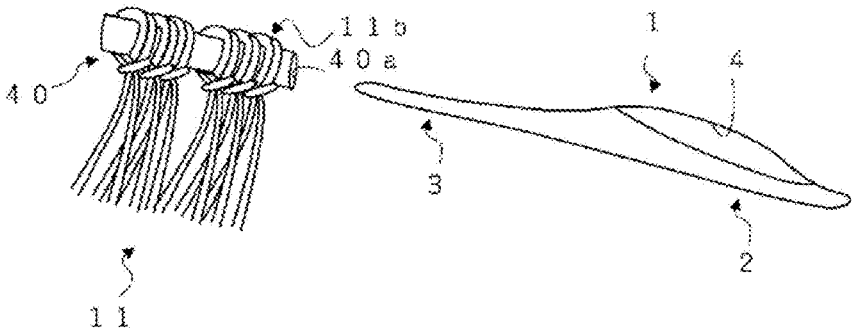
FIGS. 4A to 4D illustrate diagrams for explaining a method for passing a human hair through a loop at an end of an artificial hair, using the artificial hair fastening tool according to the present embodiment.

FIGS. 4A to 4D illustrate diagrams for explaining a method for fastening the loop 11*b* of the artificial hair element 11 to a human hair, using the artificial hair fastening tool 1. First, as illustrated in FIG. 4A, the artificial hair fastening tool 1 and the tubular member 40 are prepared. Loops 11*b* of a plurality of artificial hair elements 11 are put over the circumference of the tubular member 40 in advance to secure the plurality of artificial hair elements 11 to the tubular member 40.

Figure 4B:
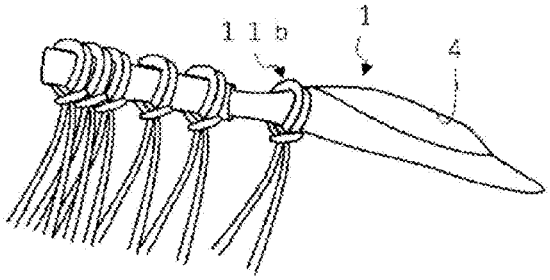

As illustrated in FIG. 4B, the rear end portion 3 of the artificial hair fastening tool 1 is inserted in the through hole 40*a* in the tubular member 40. Although the rear end portion 3 can be inserted in the through hole 40*a* of the tubular member 40, the front end portion 2 cannot be inserted in the tubular member 40 due to the thickness greater than the thickness of the rear end portion 3. This means that the tubular member 40 does not go through the artificial hair fastening tool 1 and stops while stuck on the rear end portion 3 inserted in the tubular member 40.

It is therefore possible to keep the plurality of artificial hair elements 11 handy for the operator. Each of the loops 11*b* of the artificial hair elements 11 is removed from the tubular member 40 and put over the front end portion 2 of the artificial hair fastening tool 1, thereby making it possible to move to the operation of attaching the artificial hair element 11 to a human hair 30 quickly.

Figure 4C:
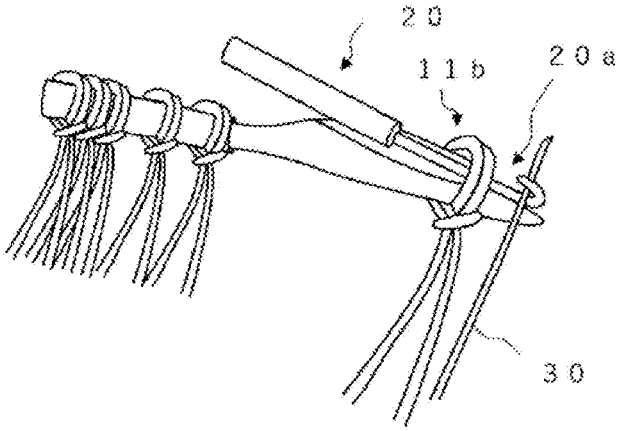

After that, as illustrated in FIG. 4C, the artificial hair element 11 is slid onto the groove 4 in the front end portion 2 of the artificial hair fastening tool 1, and the hook 20*a* at the distal end of the hook needle 20 is guided along the groove 4. Then, the human hair 30 is hooked on the hook 20*a*.

Figure 4D:
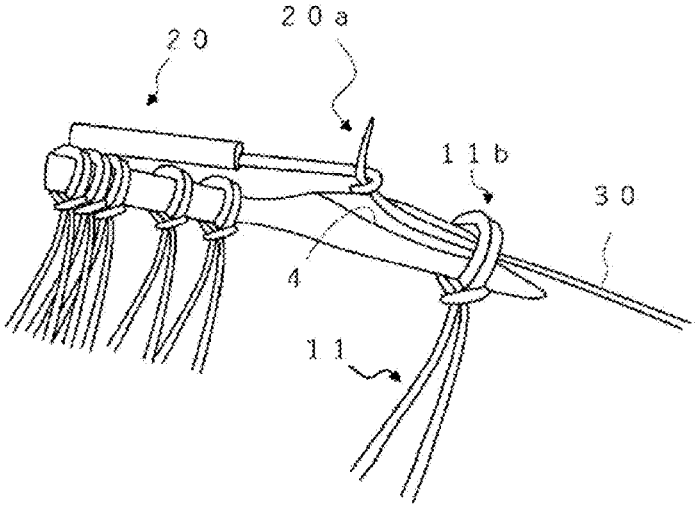

Next, as illustrated in FIG. 4D, the human hair 30 hooked on the hook 20*a* is pulled into the loop 11*b* of the artificial hair element 11 and passed through the loop 11*b*, using the hook needle 20. The groove 4 facilitates this operation of passing the human hair 30 through the loop 11*b*.

After that, the loop 11*b* of the artificial hair element 11 is slid to move to a root portion of the human hair 30, where the distal end of the artificial hair 11*a* is pulled to tighten the loop 11*b* and fasten the artificial hair 11*a* to the human hair 30.

An example in which one artificial hair element 11 (i.e., two artificial hairs 11*a*) is attached to the human hair 30 has been described herein. In a case in which a plurality of artificial hair elements 11 are to be attached, loops 11*b* of the required number of the artificial hair elements 11 may be removed from the tubular member 40 to perform the operations illustrated in FIGS. 4B to 4D.

Next, with reference to FIGS. 5A to 5F, a description will be given of a method for making a knot in a human hair to prevent the artificial hair from coming off the human hair, using the artificial hair fastening tool 1.

Figure 5A:
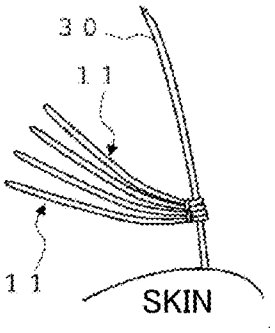
FIGS. 5A to 5F illustrate diagrams for explaining a method for tying a knot for preventing the artificial hair from coming off according to the present embodiment.
Figure 5B:
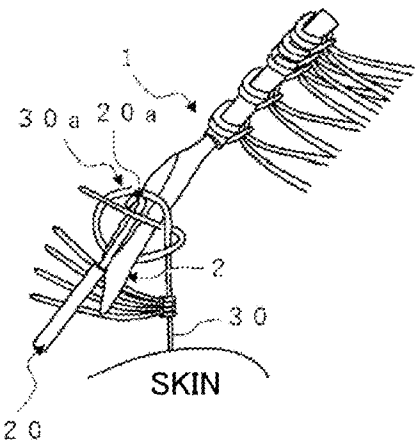

FIG. 5A illustrates a state in which two artificial hair elements 11 are fastened to a human hair 30. Then, from this state, an overhand knot 30*a* that is not yet fastened is made in the human hair 30, as illustrated in FIG. 5B.

Specifically, the human hair 30 is wound around the front end portion 2 of the artificial hair fastening tool 1 to form a loop. The hook 20*a* at the distal end of the hook needle 20 is passed through the loop along the groove 4. The distal end of the human hair 30 is hooked on the hook needle 20, and pulled in and passed through the loop, thereby forming an overhand knot 30*a* that is not yet fastened.

Figure 5C:
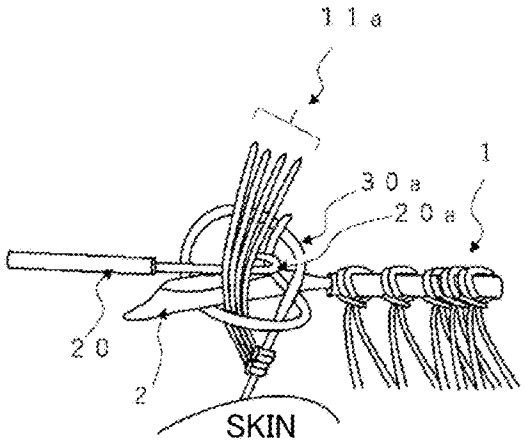

Then, while keeping the overhand knot 30*a* that is not yet fastened wound around the front end portion 2 of the artificial hair fastening tool 1, four threads of the artificial hair 11*a* are hooked on the hook 20*a* at the distal end of the hook needle 20 and pulled so that the four threads of the artificial hair 11*a* pass through the overhand knot 30*a* that is not yet fastened, as illustrated in FIG. 5C. The artificial hair 11*a* is passed through the overhand knot 30*a* that is not yet fastened, in the same direction as the direction in which the distal end of the human hair 30 is passed through the loop in making the overhand knot 30*a* that is not yet fastened.

Figure 5D:
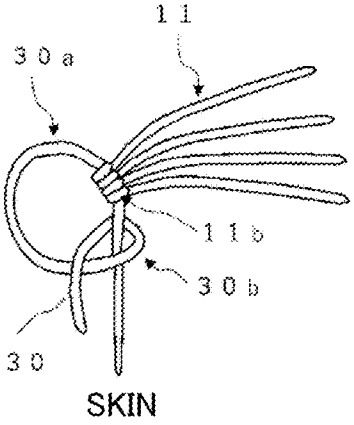

The overhand knot 30*a* that is not yet fastened is removed from the artificial hair fastening tool 1, and as illustrated in FIG. 5D, a cross portion 30*b* of the overhand knot 30*a* that is not yet fastened is shifted to a position closer to the root of the human hair than the loop 11*b* of the artificial hair.

Figure 5E:
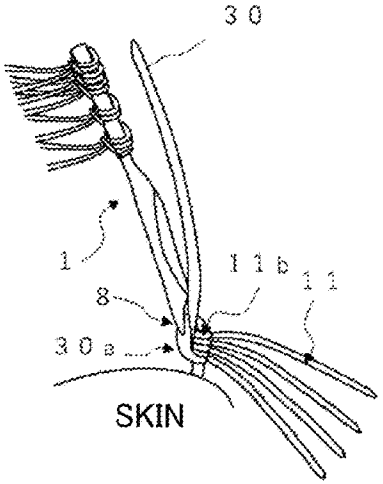

Then, the human hair 30 is pulled toward the distal end of the human hair 30, with the tip end 8 of the artificial hair fastening tool 1 pushing, and fixed to, a portion of the human hair 30 close to the root of the human hair 30, thereby making it possible to fasten the overhand knot 30*a* firmly to the position closer to the root of the human hair 30 than the loop 11*b* of the artificial hair, as illustrated in FIG. 5E. The artificial hair element 11 is therefore prevented from coming off the human hair 30.

Figure 5F:
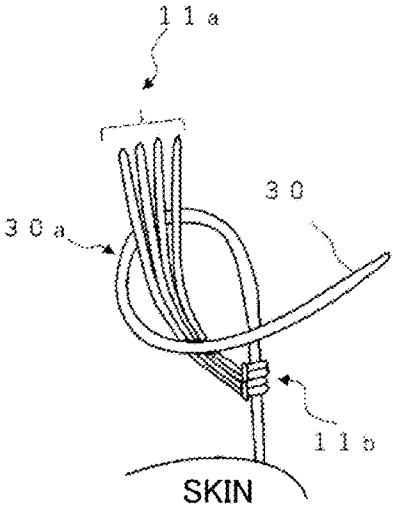

In the above method, the overhand knot 30*a* that is not yet fastened is formed in the human hair 30 as illustrated in FIG. 5B, and thereafter, the distal end of the artificial hair 11*a* is put into the loop of the overhand knot 30*a* that is not yet fastened. Alternatively, the overhand knot 30*a* that is not yet fastened can be formed in the human hair with the distal end of the artificial hair element 11 inserted in the loop of the human hair as illustrated in FIG. 5F. According to this method, the state of FIG. 5C can be achieved without going through the state of FIG. 5B, which can enhance the efficiency of operations.

Now, a method will be described in which after the growth of the human hair 30, the artificial hair fastened to the human hair is moved to the vicinity of the scalp by the length of the growth of the human hair. First, it is necessary to untie the knot for preventing the artificial hair from coming off. In a case in which at least two pieces of the artificial hair elements 11 are fastened to one thread of the human hair 30 by the method according to the present embodiment, it is easy to untie the fastened knot for preventing the artificial hair from coming off.

Figure 6:
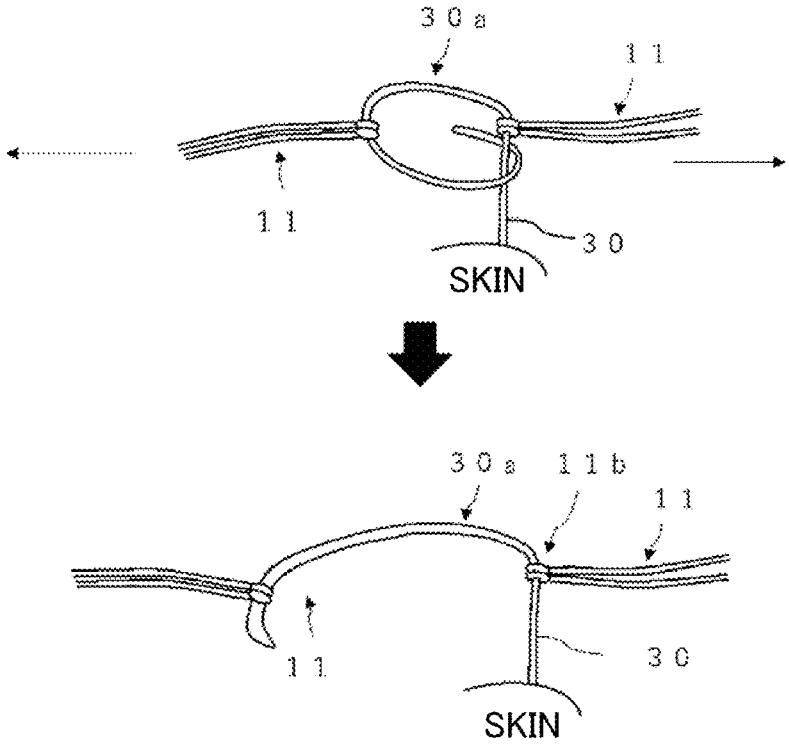
FIG. 6 illustrates diagrams for explaining a method for untying the knot for preventing the artificial hair from coming off which has been made by the artificial hair fastening method according to the present embodiment.

Specifically, the overhand knot 30*a* can be easily untied by pulling two pieces of the plurality of artificial hair elements 11 attached to the human hair 30 in directions away from each other, as illustrated in FIG. 6.

Alternatively, the overhand knot 30*a* of the human hair 30 can be untied without imposing strain on the root of the human hair 30, by securing one of the artificial hair elements 11 closer to the root of the human hair such that the loop 11*b* thereof is positioned approximately right above the root of the human hair 30, and pulling the other artificial hair element 11 in a direction perpendicular to the direction in which the human hair stands up from the skin.

After untying the overhand knot of the human hair, the loop 11*b* of the artificial hair is slid to near the root of the human hair again, and an overhand knot is formed in the human hair again as illustrated in FIGS. 5A to 5F.

As in the forgoing description, according to the artificial hair fastening tool 1 of the present embodiment, a series of operations of fastening an artificial hair element 11 to a human hair 30 and forming a knot in the human hair for preventing the artificial hair from coming off can be performed consecutively on a plurality of human hairs 30. It is therefore possible to fasten the artificial hair element 11 to the human hair 30 efficiently. As a result, the hair volume increase operations on a certain amount of human hair that can enhance the hair volume increase effect can be achieved in a short time.

In the artificial hair fastening method according to the present embodiment, the knot for preventing the artificial hair from coming off can be untied easily without imposing strain to the root portion of the human hair. Hence, natural and smooth-texture hair is achieved even when the artificial hairs are moved to positions close to the roots of the human hairs after growth of the human hair in a certain period.

DESCRIPTION OF REFERENCE CHARACTERS

1 Artificial Hair Fastening Tool
2 Front End Portion
3 Rear End Portion
4 Groove
5 Thumb Touching Portion
6 Index Finger Position
7 Middle Finger Position
8 Tip End
10 Artificial Hair Fiber
11 Artificial Hair Element
11*a* Artificial Hair
11*b* Loop
20 Hook Needle
20*a* Distal End
30 Human Hair
30*a* Overhand Knot
40 Tubular Member
40*a* Through Hole Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for fastening artificial hair to human hair using an artificial hair fastening tool, the artificial hair including:

a first artificial hair element having a first loop at one end, the first loop being capable of being tightened; and a second artificial hair element having a second loop at one end, the second loop being capable of being tightened, the method comprising:

passing at least one thread of the human hair through the first and second loops;

tightening the first and second loops to secure the first and second artificial hair elements to the human hair; and forming an overhand knot in the human hair at a position closer to a root of the human hair than the first and second loops, the artificial hair fastening tool including:

a front end portion having a spindle shape and having a tip end on one end and a groove on a circumferential surface along a longitudinal direction; and a rear end portion having a rod-like shape and extending from the front end portion toward an opposite side to the tip end.

2. A method for fastening artificial hair to human hair, the artificial hair including:

a first artificial hair element having a first loop at one end, the first loop being capable of being tightened; and a second artificial hair element having a second loop at one end, the second loop being capable of being tightened, the method comprising:

passing at least one thread of the human hair through the first and second loops;

tightening the first and second loops to secure the first and second artificial hair elements to the human hair; and forming an overhand knot in the human hair at a position closer to a root of the human hair than the first and second loops.

3. The method of claim 2, wherein the overhand knot in the human hair is formed with distal ends of the first and second artificial hair elements passed through a loop of the human hair.

* * * * *